US011776507B1

(12) United States Patent
Svirid

(10) Patent No.: US 11,776,507 B1
(45) Date of Patent: Oct. 3, 2023

(54) SYSTEMS AND METHODS FOR REDUCING DISPLAY LATENCY

(71) Applicant: Ivan Svirid, Vaughan (CA)

(72) Inventor: Ivan Svirid, Vaughan (CA)

( * ) Notice: Subject to any disclaimer, the term of this patent is extended or adjusted under 35 U.S.C. 154(b) by 0 days.

(21) Appl. No.: 17/813,929

(22) Filed: Jul. 20, 2022

(51) Int. Cl.
*G09G 5/395* (2006.01)
*G09G 5/36* (2006.01)

(52) U.S. Cl.
CPC ..... *G09G 5/363* (2013.01); *G09G 5/395* (2013.01); *G09G 2350/00* (2013.01); *G09G 2360/08* (2013.01)

(58) Field of Classification Search
CPC ..... G09G 13/161; G09G 13/1615; G09G 13/1636; G09G 5/363; G09G 5/395; G09G 5/399
See application file for complete search history.

(56) References Cited

U.S. PATENT DOCUMENTS

| | | | |
|---|---|---|---|
| 7,080,160 | B2 | 7/2006 | Cognet et al. |
| 7,403,489 | B2 | 7/2008 | Ohtani et al. |
| 7,872,985 | B2 | 1/2011 | Geile et al. |
| 7,970,966 | B1 | 6/2011 | Hobbs |
| 8,176,434 | B2 | 5/2012 | Saul et al. |
| 8,417,766 | B2 | 4/2013 | Lepeska |
| 8,692,937 | B2 | 4/2014 | Altmann |
| 8,855,469 | B2 | 10/2014 | Maharajh et al. |
| 8,868,642 | B2 | 10/2014 | Gilboa |
| 8,874,812 | B1 | 10/2014 | Hobbs et al. |
| 8,918,541 | B2 | 12/2014 | Morrison et al. |
| 8,990,446 | B2 | 3/2015 | Colenbrander |
| 9,256,393 | B2 | 2/2016 | Ivashin et al. |
| 9,471,956 | B2 | 10/2016 | Lu et al. |
| 9,497,358 | B2 | 11/2016 | Colenbrander |
| 9,578,113 | B2 | 2/2017 | Sullad et al. |
| 9,684,424 | B2 | 6/2017 | Gilboa |
| 9,740,507 | B2 | 8/2017 | Pinto et al. |
| 9,798,436 | B2 | 10/2017 | Gilboa |
| 10,304,421 | B2 | 5/2019 | Vembu et al. |
| 10,319,065 | B2 | 6/2019 | Park et al. |
| 10,369,461 | B2 | 8/2019 | Vukojevic et al. |
| 10,769,078 | B2 | 9/2020 | Cooray et al. |
| 10,818,068 | B2 | 10/2020 | Babatunde |
| 11,200,866 | B1 * | 12/2021 | Marchya ..... G09G 5/397 |
| 2007/0100473 | A1 | 5/2007 | Shvodian et al. |

(Continued)

OTHER PUBLICATIONS

Hugl, Xaver, Gaming on Wayland, Xaver's blog, Dec. 14, 2021, retrieved from https://zamundaaa.github.io/wayland/2021/12/14/about-gaming-on-wayland.html on Jan. 5, 2022.

(Continued)

*Primary Examiner* — Antonio A Caschera
(74) *Attorney, Agent, or Firm* — Wang Hardoon, P.C.

(57) ABSTRACT

Systems, apparatus, and methods for reducing display latency. An application may present a rendered frame multiple times successively, within the time period of display for the current frame. The rendered frame is presented again without the application re-rendering the scene. The application may resubmit previously rendered frames in a GPU pipeline such that a compositor software may sample, process, and display a most recent frame, creating more apparent responsiveness in a composited application to user inputs.

20 Claims, 5 Drawing Sheets

(56) References Cited

U.S. PATENT DOCUMENTS

| | | | | |
|---|---|---|---|---|
| 2007/0174410 | A1 | 7/2007 | Croft et al. | |
| 2011/0161488 | A1 | 6/2011 | Anderson et al. | |
| 2011/0214063 | A1 | 9/2011 | Saul | |
| 2014/0187331 | A1 | 7/2014 | Kim et al. | |
| 2014/0286390 | A1 | 9/2014 | Fear | |
| 2014/0359003 | A1 | 12/2014 | Sullad et al. | |
| 2015/0200998 | A1 | 7/2015 | Gu et al. | |
| 2016/0127476 | A1 | 5/2016 | Kominac et al. | |
| 2016/0364906 | A1 | 12/2016 | Kazama et al. | |
| 2017/0316541 | A1* | 11/2017 | Kim | G06T 1/20 |
| 2018/0270399 | A1* | 9/2018 | Sorbo | G09G 5/395 |
| 2019/0364302 | A1 | 11/2019 | Perlman et al. | |
| 2020/0206619 | A1 | 7/2020 | Laan et al. | |
| 2020/0238175 | A1 | 7/2020 | Smullen et al. | |
| 2020/0244559 | A1 | 7/2020 | Tamasi et al. | |
| 2020/0250372 | A1 | 8/2020 | Remington et al. | |
| 2020/0278938 | A1 | 9/2020 | Vembu et al. | |
| 2020/0322402 | A1 | 10/2020 | Sebastian et al. | |
| 2020/0372699 | A1 | 11/2020 | Subtil et al. | |
| 2020/0376375 | A1 | 12/2020 | Chen | |
| 2022/0109617 | A1* | 4/2022 | Lim | H04L 43/0852 |

OTHER PUBLICATIONS

Levien, Raph Swapchains and Frame Pacing, Raph Levien's blog, Oct. 22, 2021 retrieved May 14, 2022 from https://raphlinus.github.io/ui/graphics/gpu/2021/10/22/swapchain-frame-pacing.html.

Overvoorde, Alexander, Vulkan Tutorial, Apr. 2022, retrieved from https://raw.githubusercontent.com/Overv/VulkanTutorial/master/ebook/Vulkan%20Tutorial%20en.pdf.

The Khronos Group Inc., vkQueuePresentKHR(3) Manual Page, Version 1.2.203, Updated Dec. 20, 2021.

* cited by examiner

SYSTEMS AND METHODS FOR REDUCING DISPLAY LATENCY

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNICAL FIELD

This disclosure relates generally to the field of graphics applications. More particularly, the present disclosure relates to systems, computer programs, devices, and methods for reducing display latency.

DESCRIPTION OF RELATED TECHNOLOGY

Latency is a time delay experienced by a system. Input-to-display latency (also known as "display latency" and "input lag") is a type of latency experienced by a user of a system from the time the user enters input (e.g., a button press on a mouse/keyboard, joystick on a handheld gaming controller, voice command to a microphone, visual information to a camera, various sensor inputs, etc.) for the signal to be processed and to show the results of that input on the display. This delay may be measured in milliseconds or by display frames shown.

In many use cases, the user experience degrades as latency increases. For example, imagine a user signing their name on a tablet but a significant delay exists between when they touch their finger or stylus to the touch screen display and the line appearing on the screen. The user may alter their signature in response to not receiving immediate feedback of their input.

The experience is also felt acutely in video gaming where a user experiences their character moving through the world as though they are walking through molasses and taking actions (use an item, interact with the environment) takes a noticeable amount of time to play out on screen. In some virtual/augmented reality applications, a user may develop "cybersickness," which can create symptoms including disorientation, apathy, fatigue, dizziness, headache, increased salivation, dry mouth, difficulty focusing, eye strain, vomiting, stomach awareness, pallor, sweating, and postural instability in a user. Latency, including input-to-display latency, can contribute to cybersickness in these applications.

In an ideal environment, latency is non-existent and a user can experience no processing/display delay as if they were having a seamless experience in the "real world." Of course, latency is impossible to eliminate as propagation delays (from the input device) to the processing device, processing delays of the input, and delays in rendering/displaying the changed environment cannot be completely eliminated. Minimization of that delay to the greatest extent possible, goes a long way to providing the end user a natural user experience and reducing the causes of cybersickness.

Users may try and improve latency by improving the hardware specifications of their computer devices. A display with a faster refresh rate (e.g., 90 or 120 Hz over 60 Hz) and faster processing (at the CPU or GPU) to improve latency. Using a hardwired network connection over wireless technologies as well as improved service performance of the network connection (through increased bandwidth/throughput, reduced "ping" or network latency) can also improve input latency in networked/online environments where added delay occurs from the network connection.

Certain televisions have a "gaming mode," that when used will bypass one or more video signal processors in the TV cutting down the amount of time the television needs to process video input from a video game system. There may, however, be a noticeable drop in video quality (e.g., an increase in noise, decrease in contrast, a less sharp image, muted colors, etc.) due to the bypassed processing, but with an improvement in latency and responsive and a reduction in the display pipeline.

DETAILED DESCRIPTION

In the following detailed description, reference is made to the accompanying drawings which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without departing from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

Operating Environment

Figure 1:
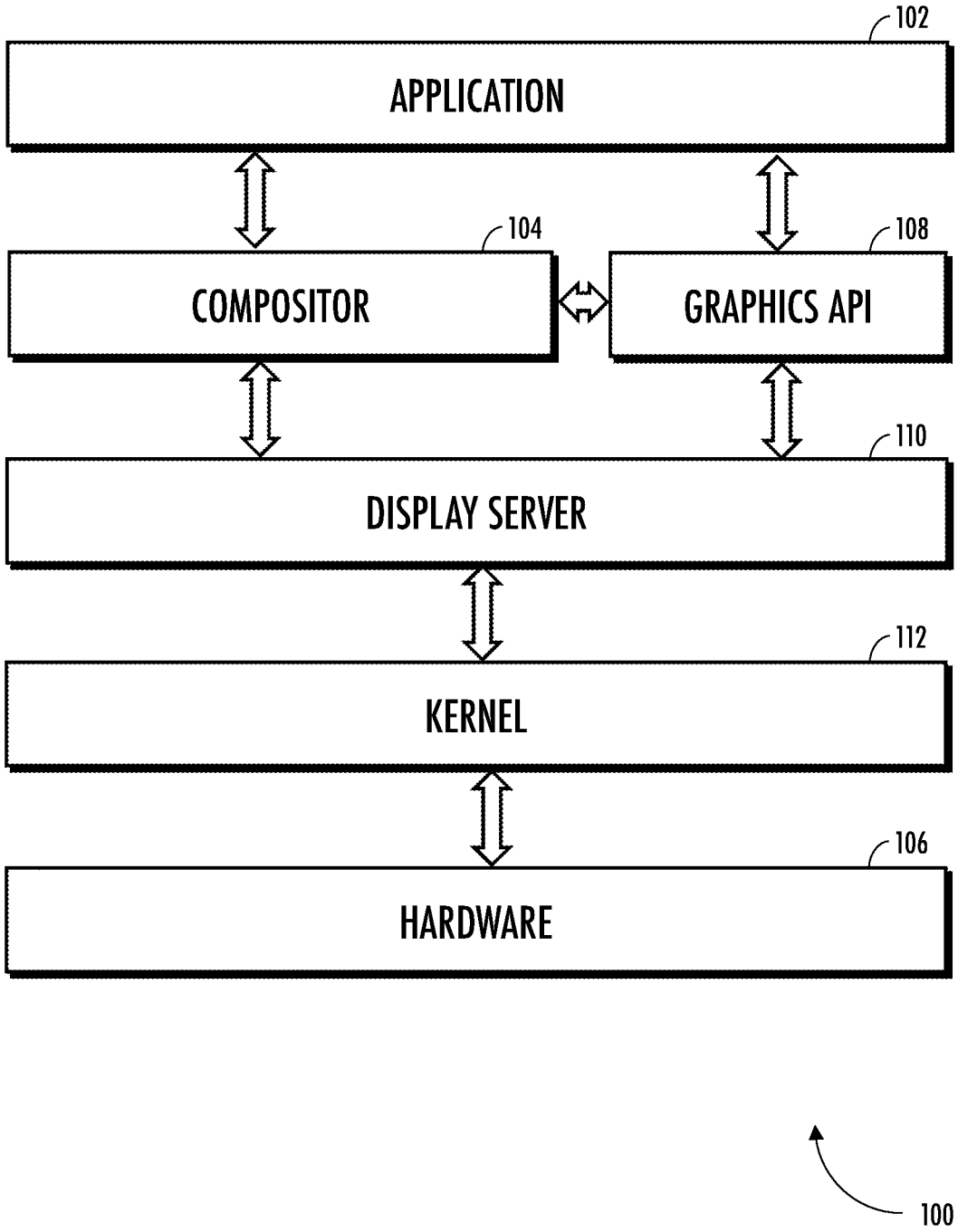
FIG. 1 illustrates an exemplary graphical user interface (GUI) application stack for an application using a compositor (composited window manager) according to aspects of the present disclosure.

FIG. 1 illustrates an exemplary graphical user interface (GUI) application stack 100 for an application 102 using a compositor (composited window manager) 104 according to aspects of the present disclosure. Exemplary GUI application stack 100 is a software stack to manage a GUI for a computer system. The GUI application stack 100 provides a platform that applications, including application 102, may access computer hardware 106 (including, e.g., CPU, GPU, display).

The GUI application stack 100 includes an application 102 in communication with a compositor 104. The application 102 may receive user input and calculate or update information based on the received user input. The application 102 may cause the the calculated or updated information to be displayed. The application 102 may not draw directly to the display. To display information, application 102 is configured to store information in a buffer or temporary storage for sampling and manipulation by the compositor 104. In some examples, the buffer or temporary storage is a frame buffer. In some examples, the application 102 does not move data directly onto a frame buffer and instead the data for display is stored in compositor specific buffers. The application 102 may send commands to the hardware 106 to draw to the display. For example, the application 102 may send commands to a GPU for processing and display, in conjunction with the compositor 104, via the graphics API 108.

The kernel 112 is a computer program at the core of a computer's operating system and has control over the hardware 106. The kernel 112 is the highest privileged portion (unrestricted) of the operating system. Applications are granted privileges to access system resources (restricted access). Some operating systems use a simple 2-privilege system, others use more complex arrangements (e.g., read/write/execute specified for user, group, everyone). Application 102 may access the hardware 106 via APIs that are exposed by the kernel 112. The kernel 112 is the portion of the operating system code that facilitates interactions between the hardware 106 and software components including the application 102, the compositor 104, the graphics API 108, and display server 110. In some examples, kernel 112 is always resident in memory. The kernel 112 is configured to control hardware resources (e.g., I/O, memory, processing hardware/GPU) via device drivers, arbitrates conflicts between processes concerning such resources, and optimizes the utilization of common resources, e.g., CPU and cache usage, file systems, and network sockets.

In rendering a frame for display, input latency occurs due to the time the application 102 takes for receiving/processing the input, updating the application environment, and rendering the new frame. Rendering a frame initiates a multi-stage pipeline process (the graphics pipeline). Pipeline processing refers to a technique for implementing instruction-level parallelism and attempts to use multiple parts of a processor during a complex operation by overlapping operations by moving data or instructions into a conceptual pipe with all stages of the pipe performing simultaneously. For example, while one instruction is being executed, the processor is decoding the next. The multi-stage pipeline does not only include the standard image processing/graphics pipeline (that includes vertex specification, vertex processing, rasterization, fragment processing, and per-sample culling operations) but also includes data movement and processing operations of the compositor 104 and display server 110. Such operations may cause a noticeable delay of a few frames in processing data through the pipeline over serial (non-pipelined) operation.

A frame buffer (also known as a framebuffer, framestore, or display buffer) is a portion of random-access memory (RAM) in hardware 106 containing a bitmap that drives a video display. A frame buffer is a type of memory buffer containing data representing all (or substantially all) the pixels in a complete video frame. GPU hardware is configured to convert an in-memory bitmap, stored in the frame buffer, into a video signal that can be displayed on a display.

A frame buffer may be designed with enough memory to store two frames of video data. In a technique known as double-buffering or page flipping, the frame buffer uses half of its memory (a primary buffer) to display the current frame. While that half of the frame buffer memory is being displayed, the secondary/other half of frame buffer memory is filled with data for the next frame. Once the secondary buffer of the frame buffer is filled, the frame buffer is instructed to display the secondary buffer instead. The primary buffer becomes the secondary buffer, and the secondary buffer becomes the primary. This switch is often done after a vertical blanking interval to avoid screen tearing where half the old frame and half the new frame is shown together.

Many displays today have a rolling scanout (also called a raster scan), rather than global scanout. This means that the pixels are updated line by line rather than updated all at once. A vertical blanking interrupt may signal the display picture has completed. During the vertical blanking interval, the raster returns to the top line of the display. The display hardware generates vertical blanking pulses. Some display technologies also use horizontal blanking intervals (new line, raster returns to start of new line).

The frame buffer is a type of memory from which the hardware 106 writes to the display. In contrast, a swap chain (also known as a screen buffer, video buffer, or off-screen buffer) is a part of memory used by an application 102 for the representation of the content to be shown on the display. The swap chain may also be a buffer that is written to by the application 102 during graphics processing. Data in the swap chain may be read and manipulated by the compositor 104. The compositor 104 may output frames for display to the frame buffer which the hardware 106 can scanout for display. In some examples, however, frame data (output by the application 102) may be written directly from the swap chain to the display.

In a specific implementation, application 102 may place frames/images on a swap chain. A swap chain is a collection of buffers that are used for rendering and displaying frames. Each time the application presents a new frame for display, the first buffer takes the place of the displayed buffer. This process is called swapping or flipping. In some examples, when application 102 draws a frame, the application 102 requests the swap chain to provide an image to render to. The application may wrap the image in one or more image view and/or a frame buffer. An image view references a specific part of an image to be used, and a frame buffer references image views that are to be used for texture, color, depth or stencil targets. Once rendered, the application 102 may return the image to the swap chain for the image to be presented for display. The number of render targets and conditions for presenting finished images to the display depends on the present mode. Common present modes include double buffering and triple buffering. The swap chain may include multiple images/frames for rendering and drawing on the display.

The information in the swap chain and/or frame buffer may include color values for every pixel to be shown on the display. Color values are commonly stored in 1-bit binary (monochrome), 4-bit palettized, 8-bit palettized, 16-bit high color and 24-bit true color formats. An additional alpha channel is used in some embodiments to retain information about pixel transparency. The total amount of memory required for the screen and frame buffers depends on the resolution of the output signal, and on the color depth or palette size.

The compositor 104, also known as a composited window manager, provides applications 102 with an off-screen buffer for each window. The compositor 104 is configured to composite the window buffers into an image representing the screen and write the result into the display memory. The compositor 104 may be configured for drawing the task bar, buttons, and other operating system-wide graphical elements. The compositor 104 may perform additional processing on buffered windows, apply 2D and 3D animated effects such as blending, fading, scaling, rotation, duplication, bending and contortion, shuffling, blurring, redirecting applications, and translating windows into one of a plurality of displays and virtual desktops. The compositor 104 tends to introduce an extra layer of latency compared to applications that are able write directly to a frame buffer or display in hardware 106. The compositor 104 may apply visual effects to be rendered in real time such as drop shadows, live previews, and complex animation.

The compositor 104 obtains frames from an application 102 and uses the frames as a texture source to apply one or more overlaid effects. In some examples, the compositor 104 receives or accesses a frame presented or otherwise output by the application 102. Composited frames may be stored in a frame buffer. In some examples, the compositor 104 outputs identical (unchanged) pixel values to the frame buffer. The compositor 104 may include: Compiz, KWin, Xfwm, Enlightenment, Mutter, xcompmgr and picom in the Linux® operating system; the Desktop Window Manager in the Windows® operating system; the Quartz® compositor in macOS®; and SurfaceFlinger/WindowManager for the Android™ operating system.

Operating system-wide graphical elements may include a task/status bar, buttons, icons, widgets, text/fonts, menus, images and graphics, pointer/cursor, and animations/transitions. These elements may be based on a user customized or operating system default theme. The elements may be based on other settings such as the time of day or seasonal settings. For example, the color temperature or a dark/light mode of screen elements may be changed based on the time of day, e.g., between sunrise and sunset or between sunset and sunrise.

A graphics application programming interface (graphics API 108) may be an interface or library that communicates with graphics hardware drivers in the kernel 112 and/or compositor 104. APIs may be cross-platform (e.g., they can be implemented to work on a variety of operating systems/kernels and with a variety of hardware allowing for portable application code.) In some exemplary implementations, graphics API 108 may include an interface between rendering APIs and the platform windowing system. The graphics API 108 may include one or more implementations of OpenGL®, Vulkan®, Glide™, Direct3D®, DirectX®, and other graphics API specifications. The graphics API 108 interacts with the hardware 106 (e.g., a graphics processing unit (GPU)), to achieve hardware-accelerated rendering. Different graphics APIs may allow applications (such as application 102) different levels of access and control to the underlying drivers and GPU hardware. While presented examples may be in a high-level pseudocode or an implementation using an exemplary API, artisans of ordinary skill will understand, given the teachings of the present disclosure, the described concepts may be applied to a variety of operating environments.

To draw on a display, the application 102 may make one or more calls to the graphics API 108. In some examples, an instance of graphics API 108 may be created and physical devices (such as GPUs in hardware 106) may be selected by the application 102 that are controllable via the graphics API 108. Logical devices of the physical device may be created with associated queues for drawing and presentation (as well as other graphics, computer, and memory transfer) operations. Such operations may be performed asynchronously and/or in parallel. The application 102 may create/windows (e.g., a window, a window surface, etc.). The application 102 and graphics API 108 may communicate with the compositor 104 to perform windowing.

In a specific implementation, application 102 may place frames/images on a swap chain. A swap chain is a collection of buffers that are used for rendering and displaying frames. Each time the application presents a new frame for display, the first buffer takes the place of the displayed buffer. This process is called swapping or flipping. In some examples, when application 102 draws a frame, the application 102 requests the swap chain to provide an image to render to. The application may wrap the image in one or more image view and/or a frame buffer. An image view references a specific part of an image to be used, and a frame buffer references image views that are to be used for texture, color, depth or stencil targets. Once rendered, the application 102 may return the image to the swap chain for the image to be presented for display. The number of render targets and conditions for presenting finished images to the display depends on the present mode. Common present modes include double buffering and triple buffering. The swap chain may include multiple images/frames for rendering and drawing on the display.

The graphics API 108 may be called by application 102 to perform rendering operations on the images in the swap chain. Such operations may invoke the graphics pipeline and various shader operations on a GPU or other hardware (e.g., in hardware 106). A command buffer may be allocated with the applicable commands to draw the images/frames in the swap chain. The command buffer may include one or more operations to perform rendering, binding of the graphics pipeline, memory transfers, drawing operations, and presentation. These operations may be provided by a command pool and passed to the hardware 106 (including the GPU) using queues. As described previously, commands (and queues) may be executed asynchronously. Some exemplary APIs expose the application 102 to asynchronous functions performed by various hardware. The application 102 may use synchronization objects, e.g., semaphores and/or fences, to ensure the correct order of execution and to ensure that images being read for presentation are not being currently rendered. Other APIs may simplify timing management and hide asynchronous operations and the use of synchronization objects from the application.

The swap chain may include a number of different presentation modes. For example, in Vulkan®, there are four main presentation modes available. The first mode is VK_PRESENT_MODE_IMMEDIATE_KH—where images submitted by application 102 are transferred to the screen without delay (e.g., waiting for scan-out to complete). The second mode is VK_PRESENT_MODE_FIFO_KHR. In the first-in-first-out presentation mode, the display is refreshed from queued images stored in the swap chain. In one implementation, the display retrieves an image from the front of the queue when the display is refreshed and the application 102 inserts rendered images at the back of the queue. If the queue is full then application 102 waits. The third mode, VK_PRESENT_MODE_FIFO_RELAXED_KHR, is similar to the second mode but but additionally includes logic to handle situations where the application 102 is late to present a frame and the queue is empty at the last vertical blank. Instead of waiting for the next vertical blank (as would occur with VK_PRESENT_MODE_FIFO_KHR), the image is transferred right away when it finally arrives. This may result in visible tearing. The fourth mode is VK_PRESENT_MODE_MAILBOX_KHR does not block the application 102 when the queue is full; instead older images are replaced by new images.

VSync, or vertical sync, is a graphics technology that synchronizes the frame rate of an application (e.g., a video game) and a display's refresh rate. Synchronization may include limiting or stopping processing by an application or a GPU to match the refresh rate of a display. When active, VSync attempts to ensure that the display is in sync with the GPU and displays every frame the GPU renders by limiting the GPU's frame rate to the refresh rate of the display. VSync and related/vendor specific technologies such as Adaptive VSync, Fast Sync, Enhanced Sync, G-Sync, FreeSync, etc., have been used as a solution to resolve screen tearing. VSync limits the frame rate output by the graphics card to the refresh rate (e.g., 60 Hz, 90 Hz, 120 Hz) of the display, making it easier to avoid higher frames per second than the display can handle. VSync prevents the GPU from performing further operations in display memory until the display has concluded its current refresh cycle—effectively not feeding the display any more information until the display is ready to accept the data. Through a combination of double buffering and page flipping, VSync synchronizes the drawing of frames onto the display only when the display has finished a refresh cycle, so a user should not see screen tears when VSync is enabled.

In some examples, where a swap chain is present, "immediate" presentation mode may be used when disabling VSync. In those examples, when an application uses "immediate" mode VSync may be disabled. In some exemplary extensions to Vulkan, an asynchronous rendering mode may be used when disabling VSync.

The graphics API 108 may be called by the application 102 to perform one or more presentation operations. Presentation operations are the last step of rendering a frame by the application 102. In some embodiments, the frame is submitted to the swap chain to be drawn on the display (or output via a network). The graphics API 108 may direct the GPU or other hardware 106 to draw the frame on an integrated, connected, or networked display.

A display server 110 (also known as a window server) is a program in a windowing system configured to coordinate input and output of applications (e.g., application 102) to and from the kernel 112 (and rest of the operating system), the hardware 106, and other applications. The display server 110 communicates with its applications over a display server protocol.

In some embodiments, the functions of the compositor 104, graphics API 108, and display server 110 may be integrated into a single program, or broken up into two, three, or more, distinct programs.

Example Operation

Screen tearing is a display artifact such that a display displays portions of multiple different frames at one time. That can result in effects where the display appears split along a line, usually horizontally. Tearing typically occurs when the display's refresh rate (how many times the display updates per second) is not in sync with the framerate generated by the application 102. While screen tearing can occur at any time, it is most prevalent during fast motion, particularly when a game runs at a higher frame rate than the display can handle or when the frame rate changes dramatically and the display is unable keep up. Screen tearing is particularly noticeable during fast-paced games with vertical image elements, such as trees, entrances, or buildings. When this happens, lines in those vertical image elements noticeably fail to line up correctly, which can break immersion in the application 102 and make the user interface appear unattractive.

When a frame has finished displaying, VSync may alert the application 102 (via e.g., an interrupt) that the frame has finished displaying on the display. A blanking period may occur between frames being sent for display. The blanking period may last, in some examples, a half millisecond. The frame buffer "flips" between active and inactive buffers and the next frame will begin to display and the frame buffer will fill with new display data. As data sits in the other buffer waiting for the flip, that data stagnates (rather than being immediately presented for display) and as a result contributes to display latency.

Figure 2:
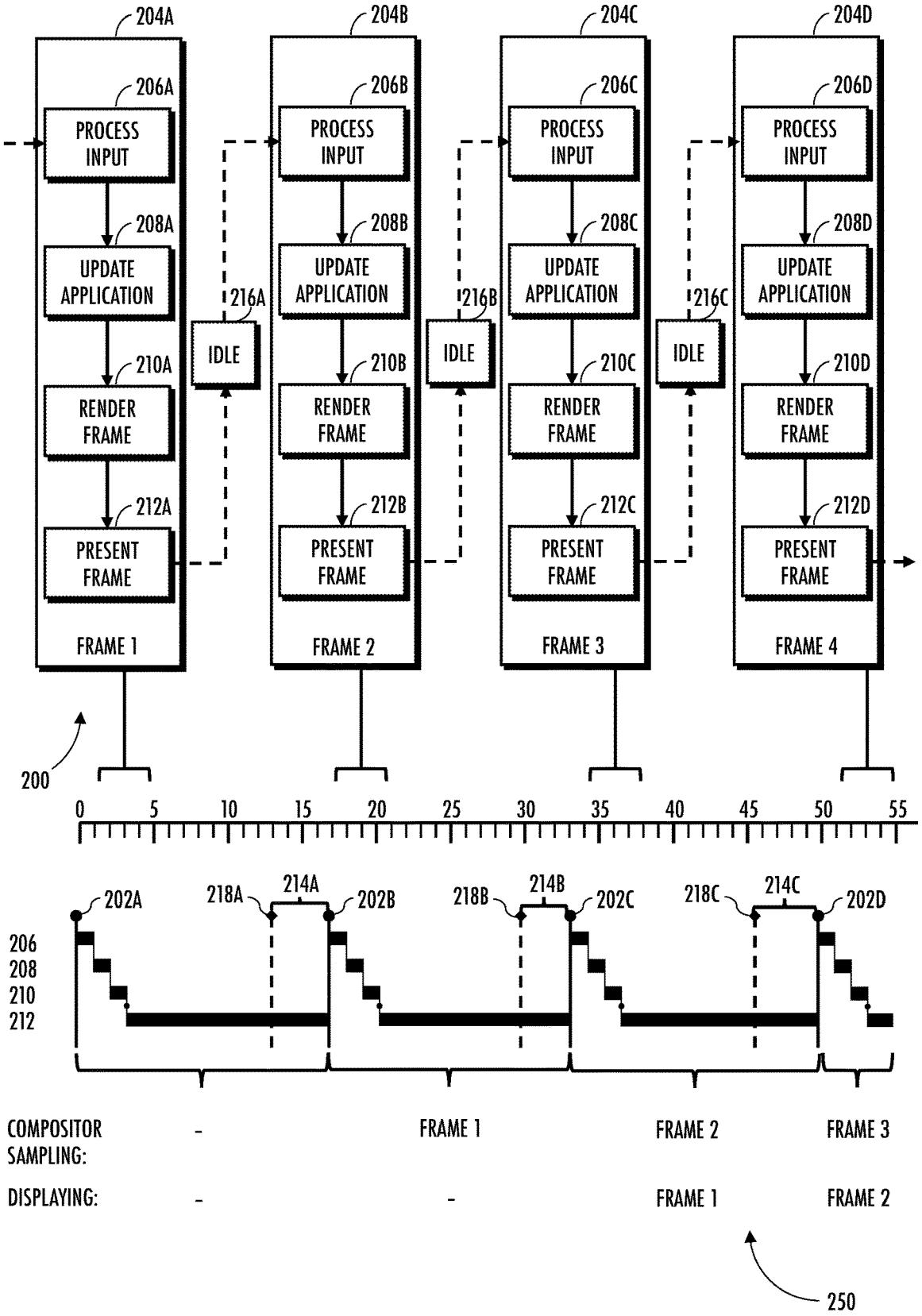
FIG. 2 illustrates an exemplary flow and timing diagram of an exemplary application running on a GUI application stack.

FIG. 2 illustrates an exemplary flow diagram 200 and timing diagram 250 of an exemplary application running on a GUI application stack 100. Timing diagram 250 indicates display scanout boundaries 202A, 202B, 202C, and 202D. The display scanout boundaries are time periods when the display has completed scanout of the current frame. The time between the scanout boundaries 202A-D is the display period for a current display frame. The display buffer flips to another buffer to display the next frame. A vertical blank (vblank) interval is the time interval between scanning out the last line of the current frame and the first line of the next frame. The vblank indicates the completion of the frame currently displayed and the beginning of scanout for the next frame. If VSync is enabled, after frame presentation the application is prevented/blocked from processing (and presenting) the next frame. Instead, the application will be blocked or will idle. At the vblank, a notification (e.g., an interrupt) is sent to the application that unblocks or allows the application to continue and process a new frame (e.g., render loop 204B).

In some embodiments, the display scanout occurs at a regular interval or substantially regular interval (due to, e.g., random timing jitter). In the illustrated example, the device has a display that refreshes at 60 frames per second (fps), there is a 16.67 ms delay between frames. In a display with a refresh rate of 90 fps, there is an 11.11 ms delay between frames. In a display with a refresh rate of 120 fps, there is an 8.33 ms delay between frames. The delay between frames may be calculated as 1/frame rate. In other embodiments, the display scanout occurs at variable period of time (as the scanout operation by the display/video card does not necessarily take the exact same amount of time due to hardware timing drift, a variable frame rate display, etc.).

The application 102 may setup and use a swap chain or a double buffer to perform graphics operations. The application 102 may present a frame for display which is then placed in a compositor buffer by the compositor for further processing. After processing the frame, the compositor places the composited frame into a display buffer for scanout. In some examples, the compositor 104 may be bypassed (in e.g., a full screen mode) and scanout may occur directly from the swap chain or an active buffer. In other examples, the compositor may use a separate buffer or set of buffers for scanout.

The system may actively scanout a frame in a first display buffer in an active state while a second display buffer in an inactive state is able to receive information about the next frame for future display. Once the frame has been drawn, a period of time elapses or a command is executed, the first buffer "flips" and becomes inactive, and the second buffer becomes active. The next frame stored in the second buffer is scanned out to the display. The first buffer (now inactive) is once again available to receive information about a future frame for future display from the application. Frame data for scanout may be received by the display buffers by the compositor.

In other embodiments, a triple or higher-order buffer may be used. In triple-buffering, scanout may shift between three buffers. In certain situations, triple-buffering may improve throughput (resulting in less stutter) if the GPU has not completed rendering a frame when the buffer is set to shift and/or VSync indicates the frame has completed scanout and the buffer shifted. Rather than not shifting the buffer, as would occur in a double-buffer scenario, and waiting for the rendering operation to complete (adding an entire frame of delay), the scanout buffer may shift to the third buffer where anther generated frame may be drawn to the display.

Flow diagram 200 and timing diagram 250 indicates time periods elapsed for passes through a render loop 204A-D by an application. In certain embodiments, the time for processing each frame of the application in the render loop 204A-D may take a variable amount of time based on the nature of responding to user input, the rendering and updates that need to be calculated, etc. In other embodiments, as illustrated in timing diagram 250, the render loop 204A-D takes the same or a fixed amount of time to complete each pass (when, e.g., portions of the render loop 204A-D run idle as padding or are processed in a fixed pipeline, or the pipeline timing is controlled by VSync).

In the illustrated example, frame 1 is processed at time o ms by the application (render loop 204A). Since there is no frame to display yet, the display is left blank. After presentation (at step 212A), the rendered frame is loaded into a buffer accessible by the compositor but is not yet ready for scanout. The application processes frame 2 from 16 ms to 34 ms (render loop 204B). During this period, the compositor composites frame 1 and stores frame 1 in an inactive display buffer. Since there is no frame to display yet, the display is left blank. From 34 ms to 50 ms, the display scans out frame 1. During that time, the application processes frame 3 (render loop 204C). The compositor composites frame 2 is and stores frame 2 in an inactive display buffer. At time 50 ms, the display scans out frame 2. The application processes frame 4 (render loop 204D). The compositor composites frame 3 and the compositor stores frame 3 in an inactive display buffer.

At step 206A-D, the device/application processes user input including receiving input from any user interaction with the application or an input device. In some examples, input may include a lack of interaction (e.g., receiving no mouse, keyboard, and/or joystick input). The application may handle any input that have occurred since the last time input was processed. For example, mouse movement/clicks, keystrokes, microphone input, visual/camera inputs, information received via a network or from a different application, etc., may be processed to determine which actions need to be taken by the application based on the input. These actions may include settings changes or user interface updates e.g., selection of buttons in the application, displaying or formatting text, determining voice/visual commands, or in-game movement/actions. As illustrated, processing input (step 206A-D) is shown as taking 1 ms to process. Processing input may take a variable amount of time (e.g., timing varies each frame) or a fixed amount of time (e.g., will take the same amount of time each frame or be padded to take a fixed amount of time).

At step 208A-D, the application updates as a result of the input and input processing. Such updates may involve advancing an environment based on the passage of time, user (and other) inputs, etc. Application updates may include, for example, physics/artificial intelligence engines run in a game environment advancing the game based on user input and the passage of time, the state of a document in a word processor may be updated based on user selections and spell check is run on the updated text, etc. As illustrated, updating the application (step 208A-D) is shown as taking 1 ms to process. Updating the application may take a variable amount of time.

At step 210A-D, the application renders the frame based on the updated application. The application may request a new (blank) image (or buffer) from the swap chain with which to render the frame. The window/environment/user interface is updated based on the application updates (from step 208A and 208B) so the user can see the changes that were made and/or get feedback as a result of the processed input. Examples of visual feedback include changes to the game world after user movement in game, underlining text in a word processor to indicate an unknown word was input, etc. As illustrated, rendering the frame (step 210A-D) is shown as taking 1 ms to process. In other examples, processing input may take a variable amount of time.

At step 212A-D, the application executes a command to present the frame for display. Presentation allows the compositor to further process the rendered frame prior to display. As illustrated, presenting the frame (step 212A-D) is shown as taking under 1 ms to process. In other examples, presenting the frame may take a variable amount of time. Due to VSync, however, once the application presents the frame, the application idles and/or is blocked from performing further actions until the next vblank.

In one example, the present command submits the result of rendering the frame back to a queue of images that are waiting to be presented on the display. In some implementations, the present command submits the result of rendering the frame to the swap chain. In one exemplary embodiment, the present command queues an image for presentation by defining a set of queue operations and submitting a presentation request to a presentation engine. Defining the set of queue operations may include waiting on semaphores for, e.g., completion of rendering and other operations. In some embodiments, the set of queue operations does not include the actual processing of the image by the presentation engine/GPU. For example, in some embodiments, the presentation command places the rendered frame in the image on the swap chain (rather than processing the image). Placing the rendered frame on the swap chain may include selecting a free/the next buffer and copying the rendered frame to the buffer.

The presented frame may be further composited by the compositor. As used herein, "compositing" and its linguistic derivatives refers to the overlay of multiple visual components. Compositing generally includes drawing task bars and other system wide user interface (UI) elements, combining/blending multiple application windows, applying a theme, etc. and other portions of the GUI application stack prior to display. Compositing is represented by the time segments of compositor sampling and processing delay 214A, 214B, and 214C. This further processing contributes to additional display latency. In some embodiments, the compositor sampling and processing delays 214A, 214B, and 214C are a static amount of time (e.g., 3 ms, 5 ms, etc.) or a static number of frames (e.g., 1 frame, 2 frames, etc.). In other embodiments, the compositor sampling and processing delays 214A, 214B, and 214C are variable and is based on the amount of processing performed by the compositor.

The compositor may composite frames for display that were rendered and presented by the application. The compositor samples previously rendered frames from one or more applications for compositing. Sampling may include accessing and copying frames from the application (via, e.g., the present command) and other applications in a compositor buffer. Once the compositor completes compositing operations, the composited frame may be ready for display and may be copied to a display buffer. Once in the display buffer, the composited frame may be scanned out at the next opportunity at the next vblank (e.g., when the current frame completes scanning out).

VSync handles synchronization between the application and the display frame rate of the display and forces a timing scheme on the application and the rendering pipeline on the GPU. When VSync is enabled, the GPU may not continue processing or allow the application to continue processing frame information until the current frame has completed displaying. After the GPU completes scanout, the GPU via the graphics API notifies the application that scanout has completed and/or the frame buffer is switching to scanout a next frame after completing the current frame.

Due to one or more of (1) stale data in the compositor buffer(s), (2) synchronization in the graphics pipeline, and/or (3) presentation occurring after the time the compositor samples data for the next display frame, the compositor fails to sample a frame from the application in the first interval between vblanks (between 0 ms and 16 ms, during the compositor sampling and processing delay 214A). As a result, the compositor samples frame 1 in the second interval between vblanks (between 16 ms and 34 ms, during the compositor sampling and processing delay 214B). The compositor samples frame 2 in the third interval between vblanks (34 ms to 50 ms, during the compositor sampling and processing delay 214C). Frame 3 is sampled by the compositor in the fourth interval (after 50 ms). Following compositor processing, the composited frames are ready for scanout at the time of the next frame (vblank). As illustrated, frame 1 is scanned out for display during the third interval between vblanks (34 ms to 50 ms) and the frame 2 is scanned out for display in the fourth interval between vblanks (after 50 ms).

As one example of presenting occurring after the time the compositor samples data, there exists an unknown time (e.g., time 218A, 218B, and 218C) when the compositor may sample applications for display. If the presentation command occurs after this time 218A-C, the compositor will only get to sample that frame in the next frame interval, after the next vblank, creating an additional frame of latency. For example, should the application execute a presentation command (e.g., step 212A) in response to receiving a VSync/vblank notification (e.g., at the time of display scanout boundary 202B), the rendered frame will not be sampled and processed by the compositor in time for compositing to complete and the composited frame to be placed in a frame buffer for scanout. Executing the presentation command in this fashion will miss the scanout boundary "deadline" (times 218A-C) for the frame. Due to the compositor sampling and processing delay 214A, 214B, and 214C, presenting the rendered frame even prior to receiving the VSync notification may not ensure that the frame data will be included in the next frame presented.

The application may idle/delay (step 216A-C) for a period of time before continuing through another pass of the render loop 204B. For example, if the application runs at 60 FPS, a new frame is presented approximately every 16.67 milliseconds. As long as the application can perform all processing of the render loop 204A and 204B, in less than that time, the application can run at a steady frame rate. The application may process the frame and then wait until it is time to render the next frame. The idle step 216A-C may ensure application does not run too fast if it is able to process a frame quickly. This may be performed expressly by the application (if the application is managing timing) or by VSync.

Following submitting the presentation command at step 212A of the render loop 204A, the application may loop through the render loop 204B-D again for rendering the next frame for display.

In an exemplary application of a shooting game running at a display rate of 60 FPS, where a user inputs an instruction to shoot a gun, the moment the trigger is pulled, the first frame output, frame 1 at the time is 16.67 ms. In the next frame, the hammer of the gun is displayed as coming down, frame 2 at time 33.34 ms (i.e., 16.67 ms+16.67 ms). In the next frame generated, frame 3, the bullet leaves the chamber, at 50.01 ms (i.e., 16.67 ms+16.67 ms+16.67 ms).

It may appear that frame 1 would be displayed at time 16.67 ms+0.01 ms, the full frame window and an extra fraction. Unfortunately, this is not the case. In practice, as illustrated in FIG. 2, frame 1 is displayed on the display when the game is already drawing frame 3 because of one or more of (1) stale data in the compositor buffer(s), (2) synchronization in the graphics pipeline, and/or (3) presentation occurring after the time the compositor samples data for the next display frame.

Exemplary pseudocode segment 1 useful for illustrating display latency in an application is shown below.

Pseudocode Segment 1

```
01:  renderloop_example_1( ) {
02:    while (1) {
03:      process_input( );
04:      update_game( );
05:      auto frame = render( );
06:      present(frame);
07:      print delta( );
08:    }
09:  }
```

The print_delta( ) function is configured to output the time difference between frames being presented. When executed, the output of print_delta( ) on an exemplary system is: 16.37 ms, 16.17 ms, and 16.97 ms. The GPU usage is at 20% capacity during the execution of pseudocode segment 1. And the display is running two frames behind. In this example, the regular frame timing has a two-frame delay due to VSync operation causing display latency.

According to techniques of the present disclosure, latency (of the two-frame delay) may be reduced by calling the present function multiple times successively on the same frame of rendered image data, within the time period of display for the current frame. The previously generated frame is presented again without the application re-rendering the scene. The application may resubmit duplicate frames in a GPU pipeline such that a compositor software may render a most recent frame, creating more apparent responsiveness in a composited application to user inputs. In some examples, this is due to overwriting frames with more current data for the compositor to sample. Additionally, by completely flushing in flight buffered frames through brute force presenting, i.e., using a plurality of presentation commands to overwrite other (e.g., older or unrelated) frames in the buffer, the most recent frame the compositor samples may be the most recent frame.

Figure 3:
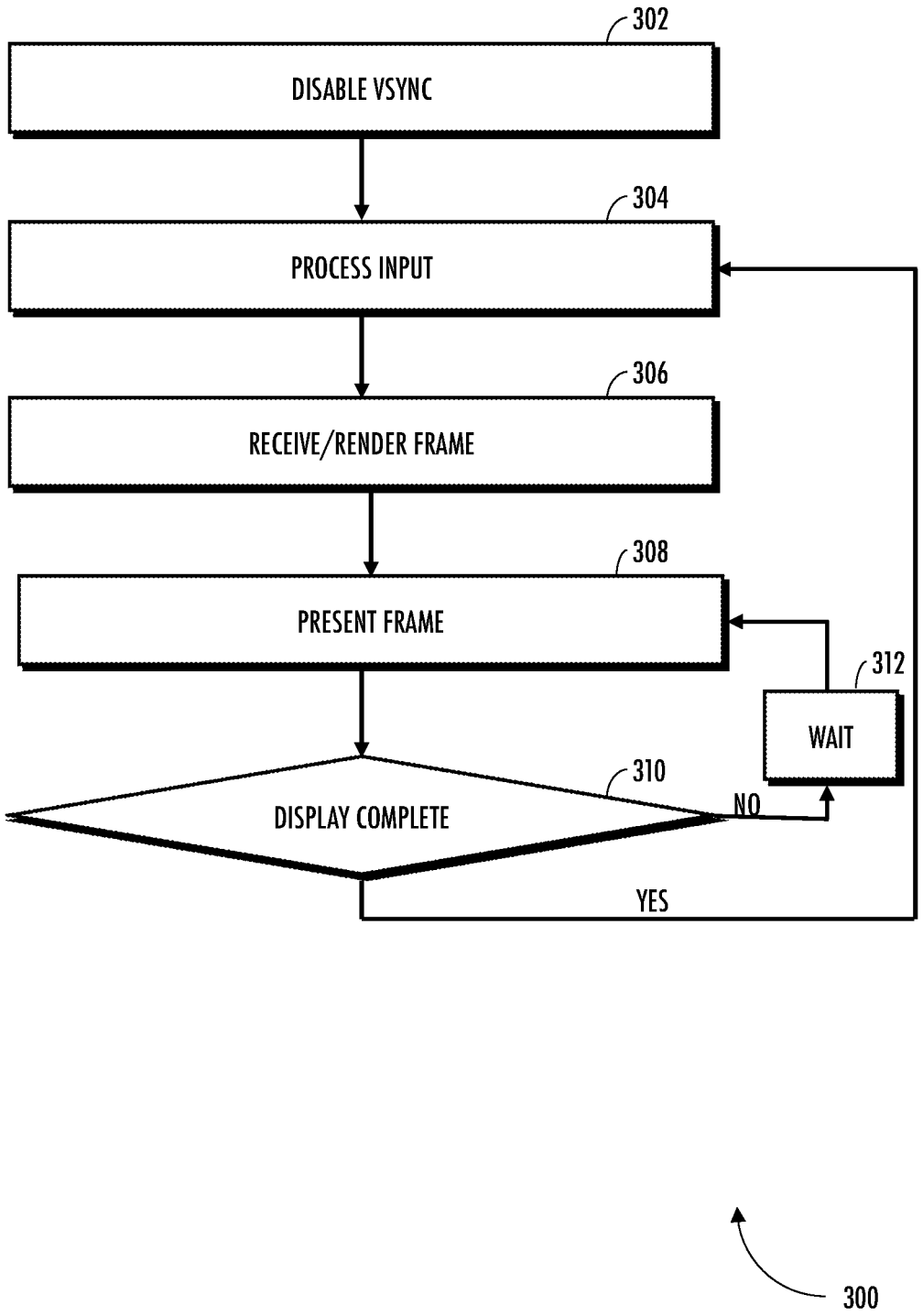
FIG. 3 illustrates an exemplary flow diagram of an exemplary application according to aspects of the present disclosure.

FIG. 3 illustrates a flow diagram of an exemplary application according to aspects of the present disclosure. The steps of method 300 may be performed by an application running on a CPU within a GUI application stack 100. The method 300 illustrates a simplified render loop for generation of frames for display and may be performed by an application/CPU (in communication with a graphics pipeline) running on an end user system or on a server that sends out display rendering information to another device via a network.

At step 302, the application (running on the CPU) disables VSync (if enabled). Different hardware vendors have other (and in some cases improved) implementations of VSync—embodiments of the present disclosure contemplate disabling those vendor specific implementations as well. VSync forces frames to wait for the display to be ready, or to signal that the display is ready, which can contribute to input lag. More broadly, any firmware that forces frames to wait for the display to be ready (or signal that the display is ready) can contribute to display latency. This may take the form of locking a display buffer from swapping until the previous frame buffer has fully written before sending it to the display (to prevent e.g., tearing). VSync may be disabled to allow for the application to handle frame presentation and management which may allow the application to present frames/swap the buffer immediately/without waiting for the next vblank/within the current frame's time window (1/frame rate). In some examples, VSync also forces the application to use a full-rendering pipeline that is controlled/synchronized by the VSync signal. Disabling VSync may allow the application to break out of the requirements and timing of the render pipeline.

In some examples, VSync (e.g., a VSync setting), or other mechanism that limits the application/GPU to the display's refresh rate in order to synchronize the frame rate of an application with a display's refresh rate, may be disabled by a function call to the GPU (via an API call). A function call can be made to swap front and back frame buffers after waiting a specified number of vertical blanks. For example, a SwapInterval call may be made (e.g., glfwSwapInterval (0)) in OpenGL. A swap interval of 1 instructs the GPU to wait for one vblank before swapping the front and back buffers. A swap interval of o instructs the GPU that no delay waiting for a vblank is needed, thus performing buffer swaps as soon as possible when rendering a frame is complete, which may disable VSync. In other exemplary embodiments, the application selects a presentation mode with VSync disabled. In Vulkan, the presentation mode may be changed to "VK_PRESENT_MODE_IMMEDIATE_KHR" which specifies that the presentation engine does not wait for a vertical blanking period to update the current image. In other examples, a user may disable VSync after being prompted by the application to change settings (e.g., a VSync setting) in a control panel or via the command line.

With VSync or another GPU/application display limiter disabled, the application is not limited by the monitor refresh rate/vertical blanking to render and present frames. This allows the application to constantly render and present frames as fast as possible. In this scenario, the application may have unnecessary resource (e.g., GPU) usage if the application is rendering new frames faster than can be displayed as illustrated in pseudocode segment 2. Rendering and presenting frames as fast as they may be generated by the system may also create screen tearing.

Exemplary pseudocode segment 2 illustrates disabling VSync and letting the application render and present frames without limitation.

Pseudocode Segment 2

```
10:  renderloop_example_2_novsync( ) {
11:    disable vsync( );
12:    while (1) {
13:      process_input( );
14:      update_game( );
15:      auto frame = render( );
16:      present(frame);
17:      print_delta( );
18:    }
19:  }
```

When executed, the output of print_delta( ) on an exemplary system is: 2.23 ms, 2.34 ms, 5.43 ms, and 2.52 ms. The GPU usage is at 100% capacity. And the display is running zero frames behind. As VSync is disabled, the application allows the render loop to process and present frames as fast as the system is able which is why the GPU usage is at 100% capacity. Unfortunately, pseudocode segment 2 wastes system resources (e.g., processing hardware, memory, battery) in rendering unneeded frames and rendered frames may tear when displayed due to the rate of presenting newly rendered frames.

To solve the foregoing, the application may manage frame timing while rendering frames. For example, the application may determine a current time and wait until one frame duration (based on the frame rate of the display) has elapsed before performing another render loop. As used herein, "frame duration," "frame time," "frame length," and "display period" refer to the period of time a frame is displayed on a display. In a fixed frame rate environment, the frame duration is equal to the reciprocal of the frame rate that the display is set to display (in frames per second). Exemplary pseudocode segment 3 illustrates disabling VSync and letting the application manage rendering and presentation of frames based on the display frame rate.

Pseudocode Segment 3

```
renderloop_example_3_novsync_artificial( ) {
    disable_vsync( );
    while (1) {
        // Global::FRAMETIME is 16.67 ms for a 60 FPS display
        int64_t wait_until = current_milliseconds( ) + Global::FRAMETIME;
        process_input( );
        update_game( );
        auto frame = render( );
        present(frame);
        sleep_until(wait_until);
        print_delta( );
    }
}
```

By idling (sleep_until( )) until a full frame duration has passed, the application ensures that the application will not generate frames at a faster rate than is usable by the system/display (based on the FRAMETIME), conserving system resources (e.g., processing hardware, memory, battery) in rendering unneeded frames. When executed, the output of print_delta( ) on an exemplary system is: 16.37 ms, 16.17 ms, and 16.97 ms. Similar to the example with VSync enabled (pseudocode segment 1), the GPU usage is at 20% capacity and the display is running two frames behind.

At step 304, the application may process input. Input may include user input (e.g., keystrokes, mouse movements, voice commands, etc.), other user/environmental input (e.g., other players movements in a computer game, randomized actions within a game) may be processed.

Processing the input may include updating an environment (e.g., a game world in a computer game, a document in a word processing application) within the memory of the device based on the input. The GPU may be used to update the environment. For example, the layout of the user interface may be updated. In another example, data representing pixels may be manipulated. In a further example, sprites, polygons, or tiles that represent objects or background may be updated.

As used herein, the environment refers to one or more data structure(s) that represent the visual elements (in part or whole) of a graphical user interface. Typically, a GPU may overlay sprites to create a 2D environment. GPUs may also use polygons, and ray tracing to create a 3D environment (see step 306 below). For example, a user click performs an action in a game (e.g., picking up an item) that may change the sprites or polygons that correspond to the user's avatar.

At step 306, the application/CPU may render a frame or receive a rendered frame. The rendering may be based on the processed input (from step 304). Alternatively, rendering may be based on automatic progression of a game environment (e.g., randomized effects, pre-configured actions). Some embodiments may directly render the frame based on the processed inputs. For examples, polygons may be drawn using rasterization; sprites/tiles may be drawn or combined and drawn; and/or ray casting/ray tracing may be used to generate the pixels that should be displayed in the frame. In some embodiments, the application may acquire an image from a swap chain and record a command buffer which draws a scene onto that acquired image. The rendering of the frame may be an expensive GPU operation in which a 3D object is drawn. For embedded systems, even 2D rendering may be an expensive GPU operation. As such, it may be desirable to limit the number of unnecessary frames rendered.

Still other embodiments may receive previously rendered frames. As used herein a server is a device that serves one or more services (e.g., a game) to one or more clients. As used herein, a client is a device that connects to the server to access the service. For example, a remote server may be an external server hosting a game or from a server hosting a remote desktop application. The application/device may send user input to the remote server and the remote server may process the input from the user device (and potentially multiple user/input devices). The remote server may update the environment and render the frame based on the updated environment. The remote server may send the frame to the application/user device for display via a network (e.g., a local area network or the internet).

At step 308, the application issues a command to present the frame. The command may include submitting a rendered frame/rendered data to a swap chain to have the frame drawn on the display. The present command may queue an image (the rendered frame) for presentation. The rendered frame may be newly rendered (i.e., never previously presented where the previous step was step 306) or was presented previously (where, e.g., the previous step was steps 310 or 312).

At step 310, a determination is made as to whether the frame has been displayed. The determination may include a determination about whether the display was refreshed since the last presentation (e.g., receive a signal about a vertical blank). In another embodiment, if the time elapsed since the beginning of the previous render operation is greater than the display frame rate, the display is assumed to be complete.

If the frame was previously displayed (step 310, "yes" branch), the application may process new input (step 304) and the next frame may be rendered (step 306). The application may continue rendering and presenting frames as needed.

If the frame was not previously displayed, (step 310, "no" branch), the application presents the frame again (at step 308). In some embodiments, the application may wait a period of time (step 312) between presentations (and re-presentations) of the previously rendered frame. For example, the application may present the frame multiple times over the course of the display period of a frame (1/the frame rate), e.g., 16.667 ms for a 60 FPS display. If the application presents the frame 3 times the application may spread those attempts over the course of the display period. This re-presentation occurs without re-processing input (at step 304), re-updating the application/game environment, or re-rendering the frame (step 306) and therefore does not incur the heavy resource costs associated with those actions. The re-presentation also is performed to fill (or flood) the frame buffer for compositor frame selection rather than, e.g., in response to an error in the original presentation. In fact, re-presentation may be performed in response to a successful original presentation. For example, in response to the original presentation, the application may receive an indication (e.g., a signal, a return value) from the graphics API 108 or the compositor 104 indicating a successful presentation.

A preset time may be determined when it is assumed the display of the frame has completed. For example, the application may determine a future time where the frame has either been drawn to the display or has failed to display. This is used to indicate the time to begin rendering the next frame. The current time, in milliseconds, is added to woo/the display frame rate. For example, if the current time is 100 milliseconds, in a 60 FPS display frame rate environment, the preset time is equal to 100+1000/60 or 116.66667. If the preset time has not been reached (when it is assumed the display of the frame has completed; at step 310, "yes" branch), the application may continue to display the first frame.

A delay may be added (at step 312) between each presentation of the first frame. The timing may depend on graphical implementations and system resources or if double/triple buffering is used. Generally, the shorter the delay (and the more presentations), the more likely a presentation of the frame would land on the scanout boundary. Certain presentation modes have newly presented (added) frames overwrite older data in the swap chain. Presenting the frame multiple times may ensure that each of the buffers in the swap chain are filled with the present frame and the next frame to be displayed will be the present frame. With at least three presentation commands per frame, this may ensure all the GPU buffers will be filled in common system default cases (e.g., with two or three buffers). For example, if the delay is 8 ms (which allows for approximately two presentation commands in a 16.667 ms display period), the probability a frame presentation would land on the scanout boundary is ~50% as there is o or only a single frame queued for display in the swap chain. If the application re-presents the frame four times (using, e.g., a 4 ms delay between presentation submissions), the application is more likely to present the frame just before the scanout boundary, and as well the buffered frames in the pipeline are at least 2-3. If the delay allows presentation of the frame at 4× the speed of the display, e.g., every 4.1675 ms at 60 FPS (a 16.67 ms frame length), the application effectively directs the compositor to select an earlier frame in the swap chain in the same time period. In other words, instead of seeing a delayed previous frame, the displayed frame may be the current or previously presented frame (rather than drawing frames that are two or three frames delayed).

Exemplary pseudocode segment 4 illustrates disabling VSync and presenting a previously rendered frame every ~4 ms until the frame duration has elapsed.

Pseudocode Segment 4

```
33: renderloop_example4( ) {
34:   disable_vsync( );
35:   while (1) {
36:     //int64_t wait_until =
    VulkanEXTENSION_GET_NEXT_SCANOUT_DEADLINE_TO_NOT_FRAMESKIP;
37:     int64_t wait_until = current milliseconds( ) + 16.67; // AKA
    Global::FRAMETIME for 60fps
38:     int64_t sleep_interval = 16.67 * 1/4; // ~4ms
39:     process_input( );
40:     update_game( );
41:     auto frame = render( );
42:     while(current_milliseconds( ) < wait_until) {
43:       present(frame);
44:       sleep_until(
45:         min(current_milliseconds( )+sleep_interval,
    current_milliseconds( ) < wait_until)
46:       )
47:     }
48:     print_delta( );
49:   }
50: }
```

The application loops or idles until a full frame display has passed, as occurs in pseudocode segment 3. This ensures that the application will not generate frames at a faster rate than is usable by the system/display (based on the FRAMETIME), conserving system resources (e.g., processing hardware, memory, battery) in rendering unneeded frames. Further, the frame is presented multiple times; every 4.1675 ms. In the illustrated example, the frame is presented up to four times depending on the time it takes to process the input, update the game, and render the frame, When executed, the output of print_delta( ) on an exemplary system is: 16.37 ms, 16.17 ms, and 16.97 ms. Similar to the example with VSync enabled (pseudocode segment 1), the GPU usage is at 20% capacity, but the display is not running any frames behind.

In Pseudocode Segment 4, after presentation (or re-presentation) of the frame, the frame idles (e.g. sleeps) until the sooner of a sleep interval (based on a threshold fraction of the frame duration for re-presentation) or the full frame duration since the beginning of processing the current frame. The threshold fraction may be based on the number of buffers (e.g., 1/the number of frame buffers, ½× the number of frame buffers, ¼× the number of frame buffers). The larger the threshold fraction (multiple of the frame buffers) the greater number of re-presentations.

In another example, frames are rendered once every frame display period however, the rendered frame is copied to one or more new images which are then presented during the same frame display period at an interval. The interval may be set (e.g., every 4 ms) or based on the number of copied images (e.g., based on the display period divided by the number of copied images).

In another example, no delay is taken (i.e., the wait is 0; at step 312) and the frame is presented multiple times immediately after rendering/receiving the frame (at step 306). In some examples, the frame is presented based on the number of buffers in the swap chain (e.g., the number of buffers in the swap chain, one more than the number of buffers in the swap chain, twice the number of buffers in the swap chain, etc.) This may ensure that each buffer of the swap chain is filled immediately with the current frame. A delay may then be taken following the presentations.

Exemplary pseudocode segment 5 illustrates disabling VSync and presenting a previously rendered frame as many times as there are buffers in the frame buffer and then idling until the frame duration has elapsed.

Pseudocode Segment 5

```
51:  renderloop_example5( ) {
52:    disable_vsync( );
53:    while (1) {
54:      // Global::FRAMETIME is 16.67 ms for a 60 FPS display
55:      int64_t wait_until = current_milliseconds( ) + Global::FRAMETIME;
56:      process_input( );
57:      update_game( );
58:      auto_frame = render( );
59:      for (i=0;i<num_buffers_in_framebuffer;i++) {
60:        present(frame);
61:      }
62:      sleep_until(wait_until);
63:      print_delta( );
64:    }
65:  }
```

The application loops or idles until a full frame display has passed, functionality similar to pseudocode segments 3 and 4. This ensures that the application will not generate frames at a faster rate than is usable by the system/display (based on the FRAMETIME/frame duration), conserving system resources (e.g., processing hardware, memory, battery) in rendering unneeded frames. The application presents the rendered frame multiple times in quick succession (i.e., without idling) before idling.

In each of these examples, the presented frames do not need to be re-rendered (or re-sent/re-received). Further, frames are rendered at the monitor's display frame rate, and frames are not rendered and presented for display as fast as possible. (Re-) presentation is not as GPU intensive as fully re-rendering the next frame. Thus, the present techniques do not burden system (e.g., GPU) resources as frames are not constantly being re-rendered.

In a further embodiment, where timing information of the scanout deadline/the next vertical blank is known or determined by the application 102 (via e.g., information from the graphics API 108) the frame can be presented prior to the estimated deadline to account for compositor overhead. The compositor overhead may be estimated based on general system information (e.g., information about the compositor generally) or based on calculated values at runtime. For example, the application may gather timing information about when one frame was or multiple frames were presented and drawn on the display to determine an approximate amount of time of compositor overhead. In another example, the application may obtain compositor overhead statistics from the graphics API. One or more earlier application deadline may be estimated based on the absolute deadline and the estimated compositor overhead. The application may present the frame prior to the one or more earlier application deadline to make sure the presented frame is drawn to the display as early as possible.

Exemplary pseudocode segment 6 illustrates an application where the timing information of the scanout deadline is obtained (VulkanEXTENSION_GET_NEXT_SCANOUT_DEADLINE_TO_NOT_FRAMESKIP) to calculate presentation times based on presenting 5 ms and 3 ms before the scanout deadline.

Pseudocode Segment 6

```
66:  renderloop_exemplary_double_buffered_example6( ) {
67:    disable_vsync( );
68:      while (1) {
69:        int64_t absolute_deadline =
     VulkanEXTENSION_GET_NEXT_SCANOUT_DEADLINE_TO_NOT_FRAMESKIP;
70:        submit_at_1 = absolute_deadline − 5;
71:        submit_at_2 = absolute_deadline − 3;
72:        process_input( );
73:        update_game( );
74:        auto_frame = render( );
75:        sleep_until(submit_at_1)
76:        present(frame);
77:        sleep_until(submit_at_2)
78:        present(frame);
79:      }
80:  }
```

Figure 4:
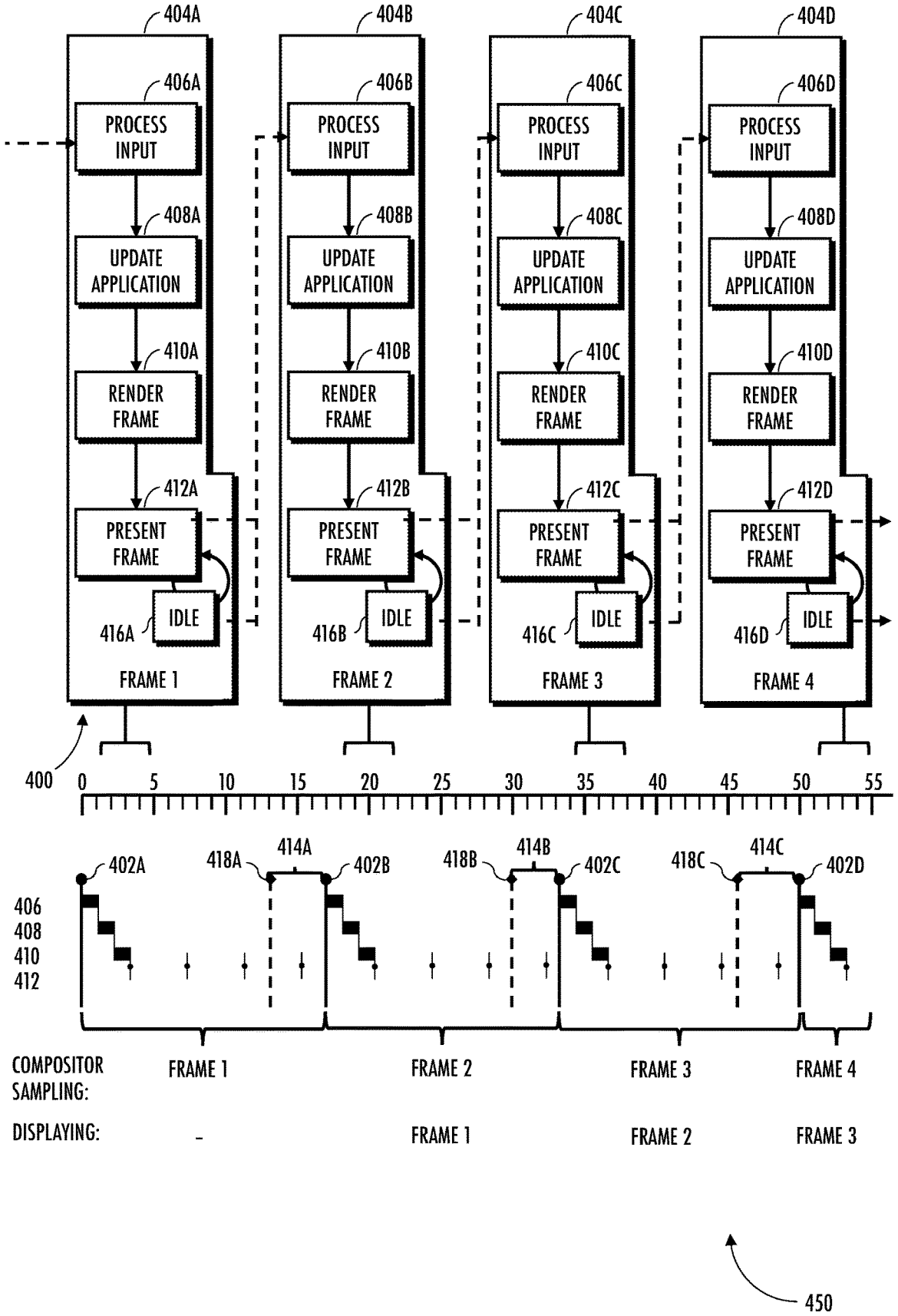
FIG. 4 illustrates an exemplary flow and timing diagram of an exemplary application running on a GUI application stack according to aspects of the present disclosure.

FIG. 4 illustrates an flow diagram 400 and timing diagram 450 of an exemplary application running on a GUI application stack 100 according to aspects of the present disclosure. FIG. 4 illustrates a similar application as FIG. 2, however VSync is disabled and the application controls the timing. In one example, a present mode may be set to "immediate" mode (e.g., VK_PRESENT_MODE_IMMEDIATE_KHR) to disable the timing restrictions of VSync. Further, the render loop 404A and 404B can present the rendered frame (generated at steps 410A and 410B) a plurality of times (at steps 412A and 412B).

In some examples, by disabling VSync and presenting a rendered frame multiple times, the application is able to simulate operating at a much higher frame rate (2×, 3×, 4×, etc.) than the display without the increased GPU/resource usage by rendering frames only once at the frame rate of the display but presenting the frame at multiple times that rate. The compositor, then, is able to sample an earlier frame (either the newly rendered frame or a copy) than the compositor would have had the application not simulated the faster frame rate.

Timing diagram 450 indicates display scanout boundaries 402A, 402B, 402C. For display, the system may actively scanout a frame in an active buffer to the display while an inactive buffer is able to receive information about the next frame for future display. Once the frame has been drawn, a period of time elapses or a command is executed, the buffers "flip" and the system scans out the next frame in the previously inactive buffer to the display while the previously active buffer is available to receive information about a future frame for future display from the application.

Timing diagram 450 indicates time periods elapsed for passes through a render loop 404A-D by an application. In certain embodiments, the timing of the render loop 404A and 404B may take a variable amount of time based on the variable nature of responding to user input, the rendering and updates that need to be calculated, etc. In other embodiments, the render loop 404A-D takes the same or a fixed amount of time to complete each pass (when, e.g., portions of the render loop 404A-D run idle as padding or are processed in a fixed pipeline).

At steps 406A-D, 408A-D, and 410A-D, the device/application processes user input, updates the application taking into account the input and input processing (of step 406), and renders the frame (at step 410) based on the updated application (at step 408) respectively. These steps are similar to the steps described with respect to steps 206-210 of FIG. 2.

At step 412A, 412B, 412C, and 412D, the application executes a command to present (e.g., display) the frame. The present command submits the result of rendering the frame back to a queue of images (in some implementations, the swap chain) that are waiting to be presented on the display. In one exemplary embodiment, the present command queues an image for presentation by defining a set of queue operations, including waiting on semaphores (for, e.g., completion of rendering and other operations) and submitting a presentation request to a presentation engine. In some embodiments, the set of queue operations does not include the actual processing of the image by the presentation engine. For example, in some embodiments, the presentation command places the rendered frame in the image on the swap chain. Placing the rendered frame on the swap chain may include selecting a free/the next buffer and copying the rendered frame to the buffer. Presentation also provides the compositor with the ability to further process the rendered frame prior to display.

The presented frame may be further processed by the compositor (to, e.g., draw task bars and other system wide UI elements, combine/blend multiple application windows, apply a theme, etc.) and other portions of the GUI application stack prior to display represented by the time segments of compositor sampling and processing delay 414A-C. This further processing contributes to additional display latency. In some embodiments, the compositor sampling and processing delays 414A-C are a static amount of time (e.g., 3 ms, 5 ms, etc.) or a static number of frames (e.g., 1 frame, 2 frames, etc.). In other embodiments, the compositor sampling and processing delays 414A-C are variable and is based on the amount of processing performed by the compositor.

The compositor may process frames for display that were presented by the application. The compositor samples frames from a variety of applications for compositing. Sampling may include accessing and copying frames from the application (via, e.g., the present command) and other applications in a compositor buffer. Once the compositor completes compositing operations, the composited frame may be ready for display and may be copied to a display buffer. Once in the display buffer, the composited frame may be scanned out at the next opportunity at the next vblank (e.g., when the current frame completes scanning out).

As VSync is disabled, the application may present a frame at any time. These presentation commands may flush out any possible number of buffered frames in flight through brute force. This may do one or more of flushing/overwriting data in compositor buffer(s) and/or flushing/overwriting data in the graphics pipeline.

In some examples, the present commands may overwrite the compositor buffers. Thus, while the application does not have control over which frame the compositor will select for processing after the current frame completes, the application can increase the likelihood of having the most recently rendered frame selected by the compositor by presenting the frame to the compositor just before the sampling and processing deadline and/or filling all of the compositor buffers with the present frame.

For example, the compositor may sample the frame presented by the application for processing and then for scanout by the display. For example, the application may execute a present command on the same rendered frame at 4× the speed of our display, e.g., at 4.1675 ms instead of 16.67 ms. By doing so, the application may direct the compositor to select an earlier frame for sampling and processing (to then place in the display buffers for scanout) than it would otherwise. In fact, the present techniques may reduce display latency by 1 or 2 frames (16.67 ms-33.34 ms).

In one example, the application may idle for a period of time (at step 416A) before re-executing a present command (at step 412A). The idle period may be based on the frame display time (e.g., one quarter of the frame time of $1/60^{th}$ of a second). The idle period may be a fixed period of time (e.g., 4 ms). The idle period may be zero (i.e., no idle period) and the present command may be executed without delay. In some other examples, instead of re-executing the present command (at step 412A), the application will begin the next stage of the render loop 404B. This may be because the period of time since the last frame ended is equal to or longer than the frame display time.

The application may re-execute a present command (at step 412A). The application may request another image from the swap chain before copying the rendered frame (created at step 410A) into the requested image. The application may then re-idle (at step 416A) and re-execute the present command (at step 412A) or continue to the next frame of the render loop 404B.

The compositor may select one of the presented images (from the same render, at step 410A) as the next frame (based on implementation specific and timing details) to process and then for scanout to the display. As VSync is not enabled, this may occur immediately following the compositor processing (e.g., the compositor sampling and processing delay 414A).

Following the presentation command (at step 412A) and idle command (at step 416A) of the render loop 404A, the application may loop through the render loop (404B) again for rendering the next sets of frames for display. This includes processing input (steps 406B-D), updating the application (steps 408B-D), rendering the frame (steps 410B-D) and presenting the frame one or more times (steps 412B-D) with a sleep/idle period between presentations (steps 416B-D). As illustrated, one frame of latency is reduced by the present techniques (with the compositor sampling and the display scanning out one frame earlier than in the example illustrated in FIG. 2).

Exemplary Apparatus

Figure 5:
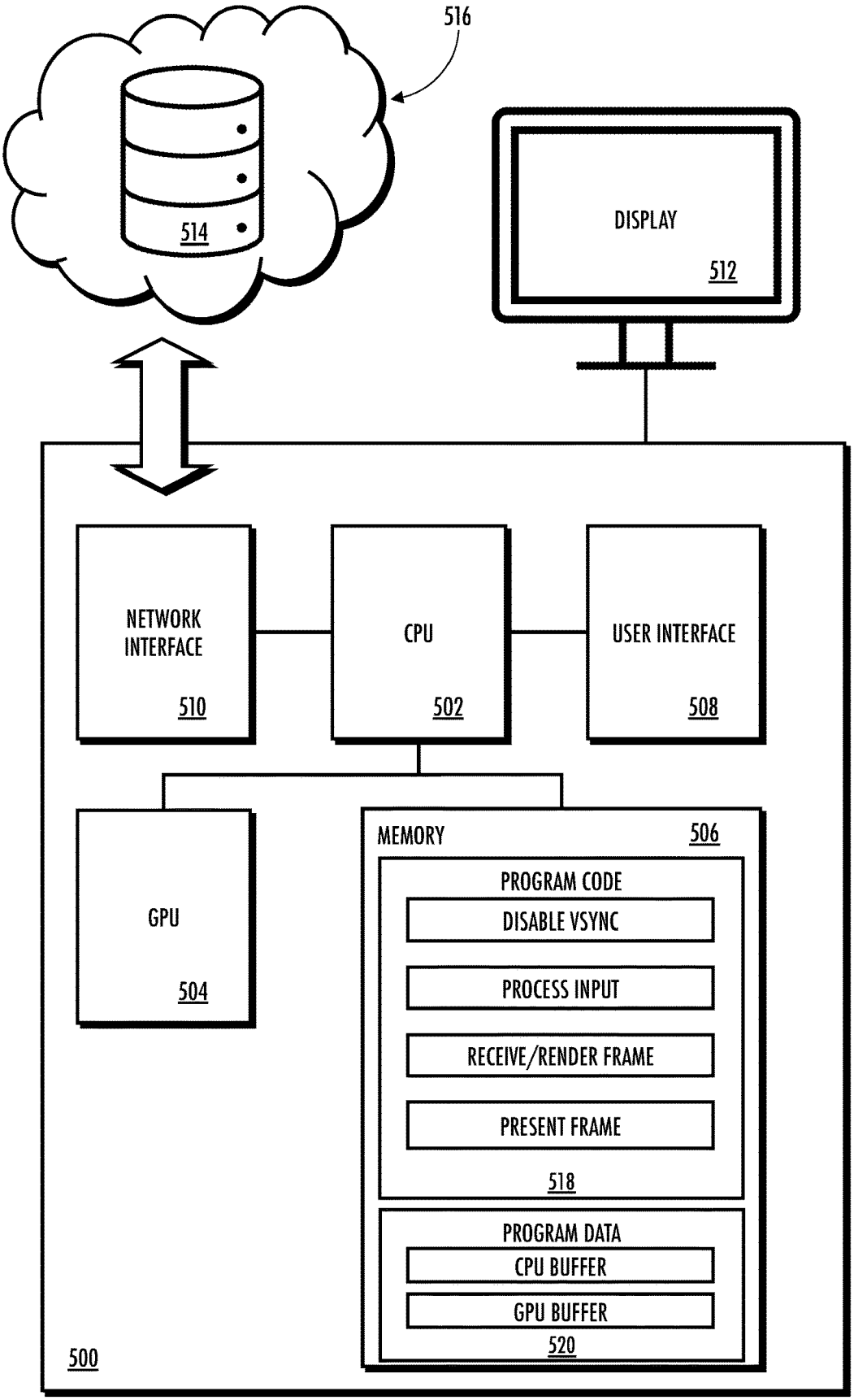
FIG. 5 is a logical block diagram of a system, useful in conjunction with various aspects of the present disclosure.

FIG. 5 is a logical block diagram of a system 500, useful in conjunction with various aspects of the present disclosure. The system 500 includes a processor subsystem (including a central processing unit (CPU 502)) and a graphics processing unit (GPU 504)), a memory subsystem 506, a user interface subsystem 508, a network/data interface subsystem 510, and a bus to connect them. The system 500 may output to display 512. The system 500 may be connected and send data to/receive data from a remote server 514 via a network 516. During operation, an application running on the system 500, in conjunction with a compositor, presents a rendered frame multiple times in order to reduce display latency. In one exemplary embodiment, the system 500 may be a computer system that can process frames for display. Still other embodiments of source devices may include without limitation: a smart phone, a wearable computer device, a tablet, a laptop, a workstation, a server, and/or any other computing device.

In one embodiment, the processor subsystem may read instructions from the memory subsystem and execute them within one or more processors. The illustrated processor subsystem includes a graphics processing unit (GPU 504) (or graphics processor) and a central processing unit (CPU 502). In one specific implementation, the GPU 504 performs rendering and display of image data; GPU tasks may be parallelized and/or constrained by real-time budgets. GPU operations may include, without limitation: graphics pipeline operations including input assembler operations, vertex shader operations, tessellation operations, geometry shader operations, rasterization operations, fragment shader operations, and color blending operations. Operations may be fixed-function operations or programmable (by e.g., applications operable on the CPU 502). Non-pipeline operations may also be processed (e.g., compute shader operations) by the GPU 504. In one specific implementation, the CPU 502 controls device operation and/or performs tasks of arbitrary complexity/best-effort. CPU operations may include, without limitation: operating system (OS) functionality (power management, UX), memory management, etc. Other processor subsystem implementations may multiply, combine, further subdivide, augment, and/or subsume the foregoing functionalities within these or other processing elements. For example, multiple GPUs may be used to perform high complexity image operations in parallel.

In one embodiment, the user interface subsystem 508 may be used to present media to, and/or receive input from, a human user. In some embodiments, media may include audible, visual, and/or haptic content. Examples include images, videos, sounds, and/or vibration. In some embodiments, input may be interpreted from touchscreen gestures, button presses, device motion, and/or commands (verbally spoken). The user interface subsystem 508 may include physical components (e.g., buttons, keyboards, switches, joysticks, scroll wheels, etc.) or virtualized components (via a touchscreen). In one exemplary embodiment, the user interface subsystem 508 may include an assortment of a touchscreen, physical buttons, a camera, and a microphone.

In one embodiment, the network/data interface subsystem 510 may be used to receive data from, and/or transmit data to, other devices. In some embodiments, data may be received/transmitted as transitory signals (e.g., electrical signaling over a transmission medium.) In other embodiments, data may be received/transmitted as non-transitory symbols (e.g., bits read from non-transitory computer-readable mediums.) The network/data interface subsystem may include: wired interfaces, wireless interfaces, and/or removable memory media. In one exemplary embodiment, the network/data interface subsystem 510 may include network interfaces including, but not limited to: Wi-Fi, Bluetooth, Global Positioning System (GPS), USB, and/or Ethernet network interfaces. Additionally, the network/data interface subsystem 510 may include removable media interfaces such as: SD cards (and their derivatives) and/or any other optical/electrical/magnetic media (e.g., MMC cards, CDs, DVDs, tape, etc.)

The memory subsystem may be used to store (write) data locally at the system 500. In one exemplary embodiment, data may be stored as non-transitory symbols (e.g., bits read from non-transitory computer-readable mediums.) In one specific implementation, the memory subsystem 506 is physically realized as one or more physical memory chips (e.g., NAND/NOR flash) that are logically separated into memory data structures. The memory subsystem may be bifurcated into program code 518 and/or program data 520. In some variants, program code and/or program data may be further organized for dedicated and/or collaborative use. For example, the GPU 504 and CPU 502 may share a common memory buffer to facilitate large transfers of data therebetween. In other examples, GPU 504 and CPU 502 have separate or onboard memory. Onboard memory may provide more rapid and dedicated memory access.

Additionally, memory subsystem 506 may include program data 520 with a CPU Buffer and a GPU buffer. GPU buffers may include display buffers configured for storage of frames for rendering, manipulation, and display of frames.

In one embodiment, the program code includes non-transitory instructions that when executed by the processor subsystem cause the processor subsystem to perform tasks which may include: calculations, and/or actuation of the sensor subsystem, user interface subsystem, and/or network/data interface subsystem. In some embodiments, the program code may be statically stored within the system 500 as firmware. In other embodiments, the program code may be dynamically stored (and changeable) via software updates. In some such variants, software may be subsequently updated by external parties and/or the user, based on various access permissions and procedures.

In one embodiment, the tasks are configured to: disable firmware based display handshaking, e.g., VSync; process input (received via the user interface subsystem 508 or via network/data interface subsystem 510); updating an application environment in response to the processed input; receive a frame rendered by a remote server 514; render a frame based on the updated application environment; and presenting the frame for display.

The system 500 may be connected to a display 512. The display 512 may be integrated into system 500 via the bus and GPU 504 or may be connected to system 500 via an external display connector (e.g., HDMI, USB-C, VGA, Thunderbolt, DVI, DisplayPort, etc.). Frames are individual images of a sequence of images that are shown on the display 512. For example, a sequence of video images may be played at 24 frames per second (or 24 Hz) to create the appearance of motion and/or a game may be rendered and displayed at 60 frames per second (or 60 Hz). A refresh rate may reflect how often the display 512 updates frames being shown. The display 512 may include any suitable configuration for displaying one or more frames rendered by the system 500. For example, the display 512 may include a liquid crystal display (LCD), touchscreen LCD (e.g., capacitive display), light emitting diode (LED) display, projector, or other display device to present information to a user of the system 500 in a visual display.

The remote server 514 includes a networking connection to network 516. Remote server 514 may operate to execute software instructions and store information. Remote server 514 may be configured to process input; updating an application environment in response to the processed input; render a frame based on the updated application environment; and send a rendered frame to a remote device (e.g., system Soo) for remote display.

Still other variants may be substituted with equal success by artisans of ordinary skill, given the contents of the present disclosure.

Additional Configuration Considerations

Throughout this specification, some embodiments have used the expressions "comprises," "comprising," "includes," "including," "has," "having" or any other variation thereof, all of which are intended to cover a non-exclusive inclusion. For example, a process, method, article, or apparatus that comprises a list of elements is not necessarily limited to only those elements but may include other elements not expressly listed or inherent to such process, method, article, or apparatus.

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

As used herein any reference to any of "one embodiment" or "an embodiment", "one variant" or "a variant", and "one implementation" or "an implementation" means that a particular element, feature, structure, or characteristic described in connection with the embodiment, variant or implementation is included in at least one embodiment, variant or implementation. The appearances of such phrases in various places in the specification are not necessarily all referring to the same embodiment, variant or implementation.

As used herein, the term "computer program" or "software" is meant to include any sequence of human or machine cognizable steps which perform a function. Such program may be rendered in virtually any programming language or environment including, for example, Python, JavaScript, Java, C#/C++, C, Go/Golang, R, Swift, PHP, Dart, Kotlin, MATLAB, Perl, Ruby, Rust, Scala, and the like.

As used herein, the terms "integrated circuit", is meant to refer to an electronic circuit manufactured by the patterned diffusion of trace elements into the surface of a thin substrate of semiconductor material. By way of non-limiting example, integrated circuits may include field programmable gate arrays (e.g., FPGAs), a programmable logic device (PLD), reconfigurable computer fabrics (RCFs), systems on a chip (SoC), application-specific integrated circuits (ASICs), and/or other types of integrated circuits.

As used herein, the term "memory" includes any type of integrated circuit or other storage device adapted for storing digital data including, without limitation, ROM. PROM, EEPROM, DRAM, Mobile DRAM, SDRAM, DDR/2 SDRAM, EDO/FPMS, RLDRAM, SRAM, "flash" memory (e.g., NAND/NOR), memristor memory, and PSRAM.

As used herein, the term "processing unit" is meant generally to include digital processing devices. By way of non-limiting example, digital processing devices may include one or more of digital signal processors (DSPs), reduced instruction set computers (RISC), general-purpose (CISC) processors, microprocessors, gate arrays (e.g., field programmable gate arrays (FPGAs)), PLDs, reconfigurable computer fabrics (RCFs), array processors, secure microprocessors, application-specific integrated circuits (ASICs), and/or other digital processing devices. Such digital processors may be contained on a single unitary IC die or distributed across multiple components.

Upon reading this disclosure, those of skill in the art will appreciate still additional alternative structural and functional designs as disclosed from the principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

It will be recognized that while certain aspects of the technology are described in terms of a specific sequence of steps of a method, these descriptions are only illustrative of the broader methods of the disclosure and may be modified as required by the particular application. Certain steps may be rendered unnecessary or optional under certain circumstances. Additionally, certain steps or functionality may be added to the disclosed implementations, or the order of performance of two or more steps permuted. All such variations are considered to be encompassed within the disclosure disclosed and claimed herein.

While the above detailed description has shown, described, and pointed out novel features of the disclosure as applied to various implementations, it will be understood that various omissions, substitutions, and changes in the form and details of the device or process illustrated may be made by those skilled in the art without departing from the disclosure. The foregoing description is of the best mode presently contemplated of carrying out the principles of the disclosure. This description is in no way meant to be limiting, but rather should be taken as illustrative of the general principles of the technology. The scope of the disclosure should be determined with reference to the claims.

It will be appreciated that the various ones of the foregoing aspects of the present disclosure, or any parts or functions thereof, may be implemented using hardware, software, firmware, tangible, and non-transitory computer-readable or computer usable storage media having instructions stored thereon, or a combination thereof, and may be implemented in one or more computer systems.

It will be apparent to those skilled in the art that various modifications and variations can be made in the disclosed embodiments of the disclosed device and associated methods without departing from the spirit or scope of the disclosure. Thus, it is intended that the present disclosure covers the modifications and variations of the embodiments disclosed above provided that the modifications and variations come within the scope of any claims and their equivalents.

What is claimed is:

1. A method for reducing display latency of an application running under a compositor comprising:

rendering a first frame of the application;

presenting the first frame of the application for display;

idling for a fraction of a frame duration; and re-presenting the first frame of the application for display following the idling.

2. The method of claim 1 further comprising disabling a vertical sync.

3. The method of claim 2, wherein disabling vertical sync comprises setting a presentation mode of a graphics application programming interface.

4. The method of claim 2, wherein, the application controls timing of a render loop of frame generation.

5. The method of claim 2, further comprising controlling generation of a second frame based on the frame duration.

6. The method of claim 2, further comprising controlling generation of a second frame based on waiting at least one frame duration since a beginning of a render loop of the first frame.

7. The method of claim 1, wherein the fraction is based on a display frame rate and one or more of a first number of frame buffers on a graphics processing unit or a second number of buffers associated with the compositor.

8. The method of claim 1, wherein re-presenting the first frame is based on idling for a sleep interval after presenting the first frame.

9. The method of claim 1, further comprising:

processing input; and updating an environment of the application based on the input.

10. The method of claim 9, wherein rendering the first frame is based on updating the environment of the application.

11. The method of claim 1, where:

receiving an indication the presenting was successful, and the re-presenting the first frame follows receiving the indication the presenting was successful and not in response to an error in the presenting.

12. The method of claim 1, where re-presenting the first frame occurs within a same frame display period as the presenting the first frame.

13. The method of claim 1, where re-presenting the first frame increases a likelihood the first frame is sampled by the compositor within a current frame display period.

14. An apparatus configured to reduce display latency of an application in an environment with a composited window manager, comprising:

a graphics processor;

a processor subsystem; and a non-transitory computer-readable medium that stores instructions which when executed by the processor subsystem, causes the apparatus to:

disable a VSync setting;

process input by the processor subsystem;

update the environment of the application based on the input by the graphics processor;

render data based on the environment of the application by the graphics processor; and write the rendered data to a next buffer of a plurality of buffers accessible by the composited window manager a plurality of times, where writing the rendered data the plurality of times occurs within a same frame display period.

15. The apparatus of claim 14, wherein writing the rendered data is based on a refresh rate of a display.

16. The apparatus of claim 15, wherein writing the rendered data is further based on a number of buffers of the plurality of buffers.

17. The apparatus of claim 14, wherein the instructions which when executed by the processor subsystem, causes the apparatus to idle until a next frame.

18. A non-transitory computer-readable medium comprising one or more instructions which, when executed by a processor, causes a device to:

disable a VSync setting;

receive a first frame rendered by a remote server;

execute a present command of the first frame for display;

receive an indication the present command was successful; and re-execute the present command of the first frame for display following receiving the indication the present command was successful and not in response to an error in executing the present command.

19. The non-transitory computer-readable medium of claim 18, where the executing the present command of the first frame and the re-executing the present command of the first frame fills each buffer of a multi-buffer frame buffer.

20. The non-transitory computer-readable medium of claim 18, where the one or more instructions, when executed by the processor, further causes the device to:

idle for a fraction of a frame duration, where re-executing the present command follows the idling.

* * * * *